US005372780A

United States Patent [19]

Limbach et al.

[11] Patent Number: 5,372,780

[45] Date of Patent: Dec. 13, 1994

[54] ALUMINUM ALLOYS SUITABLE FOR LITHOGRAPHIC PRINTING PLATES

[75] Inventors: Peter K. F. Limbach, Goettingen, Germany; Graeme J. Marshall, Banbury; Ricky A. Ricks, Freeland, both of Great Britain

[73] Assignee: Alcan International Limited, Montreal, Canada

[21] Appl. No.: 910,168

[22] PCT Filed: Nov. 22, 1990

[86] PCT No.: PCT/GB90/01804

§ 371 Date: Jul. 15, 1992

§ 102(e) Date: Jul. 15, 1992

[87] PCT Pub. No.: WO91/07514

PCT Pub. Date: May 30, 1991

[30] Foreign Application Priority Data

Nov. 22, 1989 [GB] United Kingdom ..... 8926404

[51] Int. Cl.[5] ..... C22C 21/02

[52] U.S. Cl. ..... 420/548; 101/459; 148/437; 420/528; 420/550; 420/551; 420/553

[58] Field of Search ..... 420/548, 528, 553, 551, 420/550; 148/437; 101/459

[56] References Cited

U.S. PATENT DOCUMENTS

| | | | |
|---|---|---|---|
| 4,511,632 | 4/1985 | Toma et al. | 420/548 |
| 4,610,946 | 9/1986 | Shirai et al. | 430/278 |

FOREIGN PATENT DOCUMENTS

| | | |
|---|---|---|
| 0211574 | 2/1987 | European Pat. Off. . |
| 0239995 | 10/1987 | European Pat. Off. . |
| 2131646 | 11/1972 | France . |
| 1608198 | 12/1970 | Germany . |
| 2737232 | 3/1978 | Germany . |
| 3406406 | 10/1984 | Germany . |
| 63-45352 | 2/1988 | Japan . |

*Primary Examiner*—Richard O. Dean
*Assistant Examiner*—Robert R. Koehler
*Attorney, Agent, or Firm*—Browdy and Neimark

[57] ABSTRACT

Aluminium alloys are described which after suitable processing can be used to produce lithographic printing plates of improved stoving resistance. The alloys consist es',Vially of at least 99.00% by weight of aluminium, from 0.02 to 0.15% by weight in total of zirconium and/or hafnium and from 0.05 to 0.25% by weight of manganese, with the remainder being incidental impurities. Improved stoving resistance is particularly shown with 0.02 to 0.08% zirconium and from 0.05 to 0.15% manganese, especially when stoving takes place at 240° C. or above.

6 Claims, 5 Drawing Sheets

COMPOSITION

ALUMINUM ALLOYS SUITABLE FOR LITHOGRAPHIC PRINTING PLATES

FIELD OF INVENTION

The present invention relates to aluminium alloys which after suitable processing can be used to produce lithographic printing plates.

BACKGROUND OF INVENTION

As is described in U.S. Pat. No. 4,610,946, aluminium with a purity of 99.50% by weight or higher and having small amounts of iron and silicon therein are known to produce good quality printing plates using the processing steps described in that patent. As the patentee points out, however, existing alloys such as AA1050 are known to be adversely affected by the heating step needed to "burn in" or "stove" the finished lithographic printing plate in order to harden the image areas and thereby enhance the printing plate's life. Stoving can reduce the strength and cause distortion of lithographic sheet material by causing recovery or recrystallisation of the heavily cold worked metal. A useful indication of the likely amount of distortion that may occur is provided by measuring the change in yield or ultimate tensile strength caused by stoving. A large loss in strength indicates an unacceptable level of distortion, and difficulties in handling and mounting for use in service.

U.S. Pat. No. 4,610,946 seeks to provide an improved printing plate capable of withstanding temperatures higher than 280° C. without any distortion of the plate which could lead to difficulties in mounting the printing plate on the printing cylinder of a press. The improvement described in that patent consists of the addition of from 0.02 to 0.20% by weight of zirconium, whilst maintaining the remaining alloying elements and impurities at the levels set for the known alloy AA1050. Of these alloying elements the following preferred ranges are described in U.S. Pat. No. 4,610,946:

| | |
|---|---|
| Iron | 0.40% by weight or less |
| Silicon | 0.20% by weight or less |
| Manganese | 0.05% by weight or less |
| Copper | 0.05% by weight or less |
| Titanium | 0.05% by weight or less |
| Residual Impurities | 0.05% by weight or less |

As can be seen from the results given in Tables 2, 3 and 4 of U.S. Pat. No. 4,610,946, at temperatures below 280° C. the improvement in yield strength and performance of the finished printing plates were only very slightly improved by the addition of zirconium, and further that there was little difference between addition at the rate of 0.05% Zr and of 0.16% Zr.

In order to avoid the distortion problems associated with stoving temperatures greater than 280° C., temperatures of about 240° C. are often preferred by those in the art, but even at these temperatures some softening of the aluminium base alloy is noted, which softening adversely affects the quality of the printing plate for the reasons previously mentioned.

In an attempt to overcome this softening, an addition of zirconium was tried by the Applicants in line with the teaching of U.S. Pat. No. 4,610,946, but although a small improvement was noted, some softening was still evident. In addition, it was found that batch interannealing of metal with up to 0.13% zirconium resulted in the growth of extremely large grains which are elongated in the rolling direction, some of which were several centimetres long. Such grains were found to adversely affect the quality of the surface of the electro-grained sheet, although the Applicants noted that these large grains did not form if continuous annealing was used.

In EP-A-0289844, the problem of the softening of aluminium printing plates at about 240° C. is recognised and the described solution consists of closely limiting both the manganese and iron content of the aluminium alloy and of utilizing a fabrication process which is difficult to control in order to achieve a particular structure in the alloy in which the type, quantity and number density of the secondary phases therein are carefully controlled. As will be appreciated by those skilled in the art careful control of the processing conditions of sheet material is difficult and expensive to achieve on a commercial scale, and in any event it has been found by the Applicants that the improvement in resistance to this softening of the alloy is not as good as is desired.

There therefore exists a need for an aluminium alloy which resists more successfully the softening encountered during heating at about 240° C. without having a utilize the type of difficult and expensive production conditions described in EP-A-0289844, and which is also amenable to batch annealing as well as continuous annealing.

SUMMARY OF INVENTION

The present invention seeks to provide such an improved alloy by utilizing the combination of both manganese and zirconium.

Contrary to the teaching of U.S. Pat. No. 4,610,946, it has unexpectedly been found that by increasing the manganese content beyond the 0.05% by weight limit described by the patentee, whilst at the same time restricting the zirconium content to 0.15% by weight or less, a significantly superior printing plate alloy can be produced without the need for the production conditions described in EP-A-0289844. Although some improvement in resistant to softening might have been predicted by the addition both of manganese and of zirconium over and above a known alloy such as AA1050A, which contains a Fe maximum of 0.40% and a Si maximum of 0.25%, it has unexpectedly been found that the improvement achieved by the use of this combination of manganese and zirconium exceeds the sum total of the anticipated improvements, i.e. in some way as yet not fully understood there is a synergistic effect between the manganese and the zirconium which produces an aluminium alloy which is more resistant to softening during stoving at about 240° C. whilst at the same time not adversely affecting its properties as a lithographic plate base material.

BRIEF DESCRIBED OF DRAWING

DETAILED DESCRIPTION OF EMBODIMENTS

Figure 1:
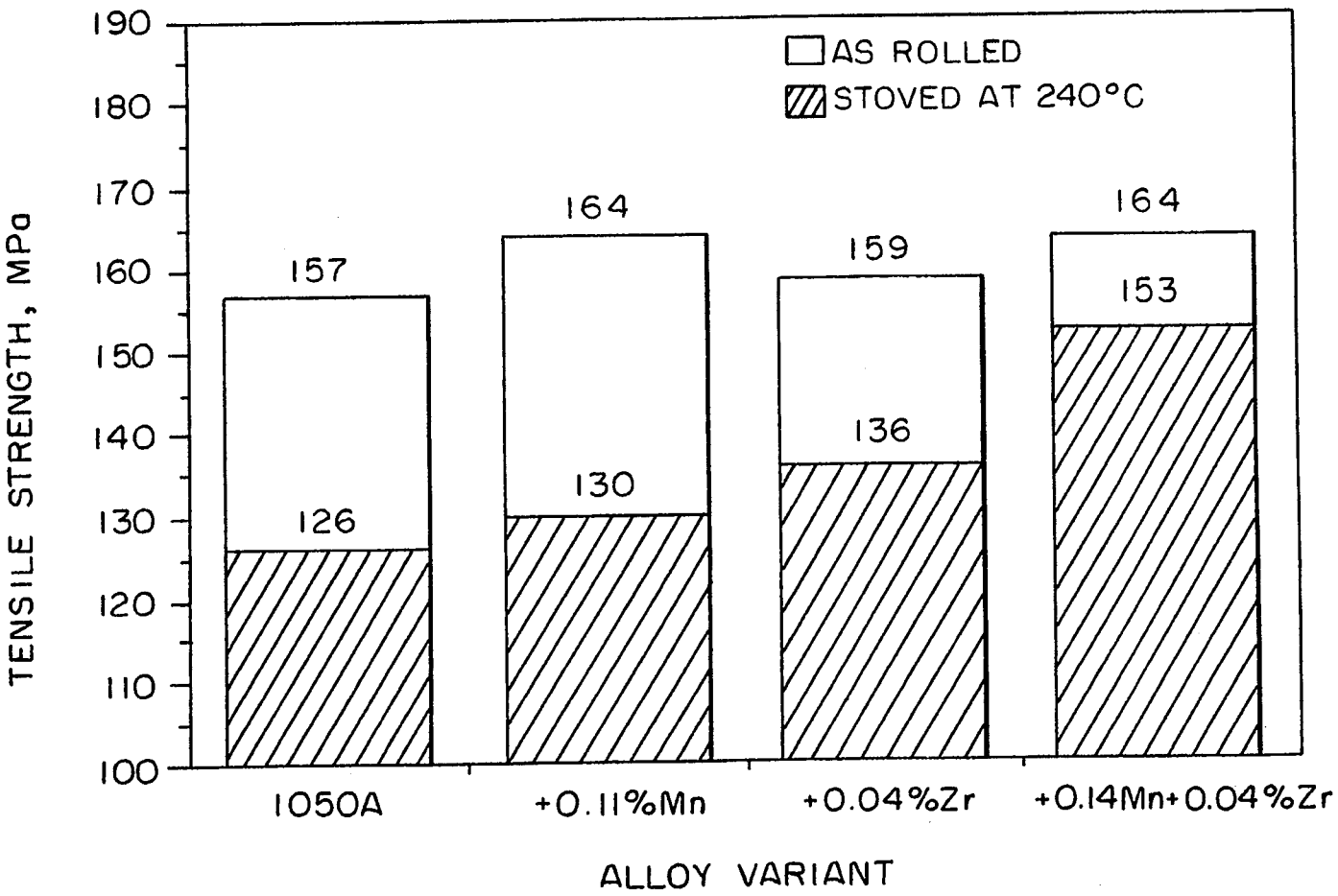
FIG. 1 is a bar graph illustrating features of Example 1 below, plotting alloy variant against tensile strength.

Although the combined use of manganese and zirconium in aluminium alloys is known from, e.g. U.S. Pat. No. 4,511,632, such alloys have heretofore been considered only for use at relatively high temperatures, i.e. as brazing alloys.

In accordance with the present invention there is provided an aluminium alloy suitable for processing into a lithographic printing plate consisting essentially of at least 99.00%, preferably at least 99.30% by weight of aluminium, from 0.02 to 0.15%, preferably 0.02 to 0.08%, by weight of zirconium, and from 0.05 to 0.25% preferably 0.05 to 0.15%, by weight of manganese, with the remainder being incidental impurities, wherein when the aluminium content is from 99.00 to 99.50% by weight the weight ratio of iron to silicon in the alloy is above 1.5:1. Hafnium can replace all or some of the zirconium since in the present invention hafnium and zirconium are essentially functionally equivalent.

Whilst not wishing to be bound by theory, it is believed that the improved properties of the alloys of the present invention are achieved by retaining in solid solution substantially all of the zirconium added, whilst during the processing of the alloy into a sheet suitable for use as a lithographic plate some Al-Mn-Si particles are precipitated whilst the remaining manganese is retained in solid solution. The combined effect of the manganese and zirconium solute on the one hand and the fine dispersion of these particles on the other hand appears substantially to prevent the recovery process that normally leads to the described softening of such aluminium alloys at around 240° C.

The preferred 0.08% zirconium limit is important since it has been found that above this level precipitation of zirconium begins to occur and this can encourage the formation of grains of a large size during hot rolling or annealing which significantly adversely affect the quality of the lithographic plates made from the alloy. Batch annealed sheet containing more than about 0.15% zirconium tends to be so coarse grained that it is impossible to electrograin the material satisfactorily. As regards the lower limit, no improved effect has been observed below a level of about 0.02% by weight. Preferably the zirconium content should be about 0.04% by weight.

As regards manganese, the desired improvement in stoving resistance beings to occur above 0.05% by weight when the manganese is present with zirconium. Higher levels of manganese, e.g. up to 1%, have the beneficial effect of assisting the control of grain size during batch annealing. However, such a high level of manganese is undesirable because it causes streaking of the surface (roughness) and discoloration of the lithographic sheet during electrograining (see for example EP 0289844). The optimum upper level of manganese is therefore determined by a balance between the desirable stoving resistance and grain refining effects on the one hand and the onset of an undesirable level of streaking and discoloration on the other hand. In practice the satisfactory upper manganese level in the presence of zirconium is 0.25%, with between 0.05 and 0.15% by weight being preferred.

For the remaining natural impurities such as zinc, it is preferred that their concentrations fall within the limits laid down for AA1050A and preferably are less than 0.02% for each impurity. Generally the ratio of iron to silicon in the alloy should be less than 6:1 and preferably above 1.5:1, most preferably about 4.5:1. Where the aluminium content is from 99.00 to 99.50% by weight the weight ratio of iron to silicon in the alloy should be above 1.5:1. The processing of the alloy of the invention to form a lithographic plate, including the types of graining processes that can be used, are described in U.S. Pat. No. 4,610,946.

Embodiments of the present invention will now be described, by way of illustration, with reference to the following Examples taken in conjunction with FIGS. 1 to 5 of the accompanying drawings.

EXAMPLE 1

Using aluminium alloy AA1050A as a reference, three different alloys were produced from the alloy and samples of all four were prepared in sheet form ready for processing into lithographic printing plates in accordance with the following procedure:

A 150×100×25 mm ingot was heated at 50° C./hour to 580° C., held at this temperature for six hours, cooled at a rate of 50° C./hour to 500° C. and then hot rolled to a thickness of 4.5 mm. The hot rolled plate was then cold rolled to a thickness of 2.25 mm, was batch annealed by heating at a rate of 30° C./hour to 450° C., was held at this temperature for two hours, and finally was cooled at a rate of 30° C./hour to room temperature. The annealed sheet was then cold rolled from 2.25 mm to a thickness of 0.30 mm.

In the first of the three modified alloys the manganese content was adjusted to 0.11% by weight, in the second the zirconium content was adjusted to 0.04% by weight, whilst in the third both the manganese and the zirconium contents were adjusted to 0.14 and 0.04% by weight, respectively. The reference 1050A alloy contained essentially no zirconium and only a trace of manganese.

After processing into sheets ready for fabricating into printing plates, the ultimate tensile stress (UTS) of samples of the four alloys were measured at room temperature both initially and after heating of the alloys to 240° C. for ten minutes. The results are presented in barchart form in the accompanying FIG. 1 in which the unshaded columns represent the results for the material as rolled measured at room temperature, whilst those which has been cross-hatched show the results for the alloys after heating to 240° C. for ten minutes and then air cooling.

Although as expected, for all four alloys tested there is a reduction in UTS after the heating step, it can be seen from FIG. 1 that the reduction in strength for the alloy of the present invention which contains zirconium and manganese at a level greater than 0.05% by weight is significantly smaller than any of the other three alloys tested and is less than the sum total of the improvements shown by the two other modified alloys.

This reduction in loss in strength is an indication that little or no distortion of the sheet will occur during commercial stoving operations and that extremely good quality printing plates will be produced from the alloy of the present invention which will exhibit improved handling and ease of mounting in the printing press.

EXAMPLE 2

TABLE 1

| | Fe | Si | Mn | Zr | Ti |
|---|---|---|---|---|---|
| weight % | 0.20 | 0.09 | 0.10 | 0.04 | 0.01 |

TABLE 1-continued

| |
|---|
| remainder Al and residuals <0.01 |

Direct chill cast ingots 600 mm thick, having the composition given in Table 1, were heated to 580°-610° C. for at least 2 hours. The ingots were hot rolled at 500°-300° C. to strip 4.2 mm or 3.5 mm thick and coiled. The coils were then cold rolled to 0.3 mm thick according to the following procedure:

Coil 1

Cold roll from 3.5 mm to 0.3 mm thick.

Coil 2

Cold roll from 4.2 mm to 2.2 mm thick, anneal at 430° C. for 2 hours and then cold roll to 0.3 mm thick.

Coil 3

Anneal at 430° C. for 2 hours, cold roll from 4.2 mm to 0.3 mm thick.

Samples from each coil were then stoved for ten minutes at 200°, 240° or 270° C. and the longitudinal and transverse tensile properties measured. The results are summarised in Tables 2(a)-2(c) in which the transverse properties are given in brackets.

TABLE 2(a)

| | Coil 1 Longitudinal Properties (Transverse Properties) | | |
|---|---|---|---|
| Stoving Treatment | Proof Stress MPa | UTS MPa | Elongation % |
| As cold Rolled | 182 (189) | 198 (207) | 3.61 (3.24) |
| 10 min at 200° C. | 178 (—) | 194 (—) | 3.14 (—) |
| 10 min at 240° C. | 167 (180) | 182 (191) | 3.22 (2.20) |
| 10 min at 270° C. | 156 (—) | 166 (—) | 3.78 (—) |

TABLE 2(b)

| | Coil 2 Longitudinal Properties (Transverse Properties) | | |
|---|---|---|---|
| Stoving Treatment | Proof Stress MPa | UTS MPa | Elongation % |
| As cold Rolled | 158 (168) | 172 (184) | 3.32 (2.85) |
| 10 min at 200° C. | 151 (—) | 168 (—) | 2.59 (—) |
| 10 min at 240° C. | 139 (157) | 153 (167) | 2.97 (2.19) |
| 10 min at 270° C. | 130 (—) | 139 (—) | 3.64 (—) |

TABLE 2(c)

| | Coil 3 Longitudinal Properties (Transverse Properties) | | |
|---|---|---|---|
| Stoving Treatment | Proof Stress MPa | UTS MPa | Elongation % |
| As cold Rolled | 168 (177) | 184 (196) | 3.14 (2.41) |
| 10 min at 200° C. | 163 (—) | 182 (—) | 2.00 (—) |
| 10 min at 240° C. | 154 (166) | 168 (176) | 2.17 (1.49) |
| 10 min at 270° C. | 139 (—) | 146 (—) | 1.68 (—) |

The hot rolled strip was found not to show recrystallisation after coiling at 4.2 mm thick, whereas similarly treated strip, not containing zirconium, is usually at least partially recrystallised at its surface at this stage. If is to be noted that the annealing treatment carried out on coil 3 induced full recrystallisation.

EXAMPLE 3

Example 1 was repeated using a series of modified alloys based on the composition AA 1050A, but in which the manganese and zirconium contents were varied up to 0.25 and 0.15% weight, respectively. After processing into sheets ready for fabricating into printing plates as described in Example 1, the ultimate tensile stress (UTS) of samples of the different alloys were measured both as rolled (AR) and after heating of the alloys to either 240° C., 270° C. or 300° C. for ten minutes followed by air cooling.

The results are presented in bar-chart form and in graph form in the accompanying FIGS. 2 to 5.

Figure 2:
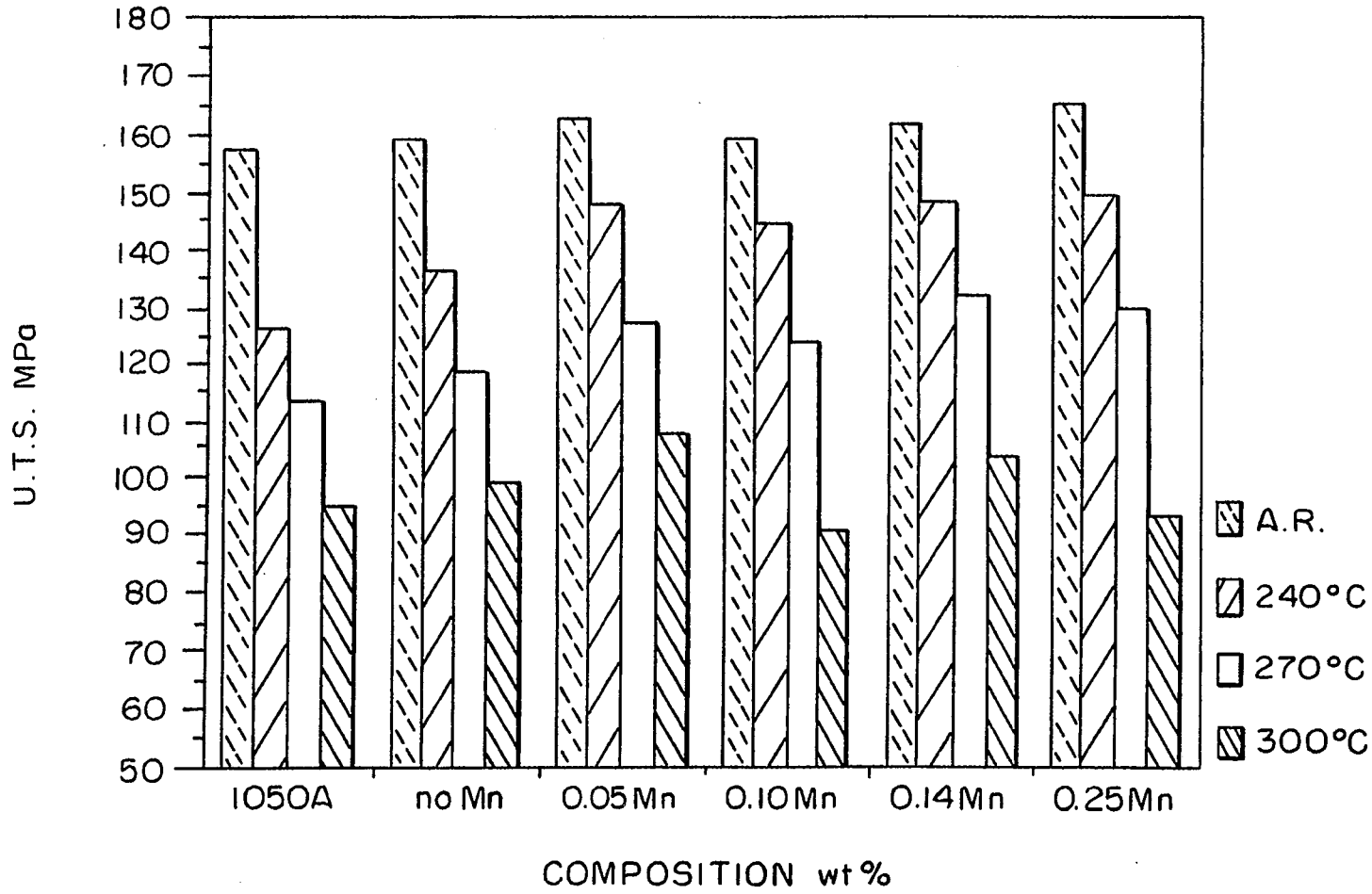
FIG. 2 is another bar graph dealing with Example 3 below, and plotting composition against tensile strength.
Figure 3:
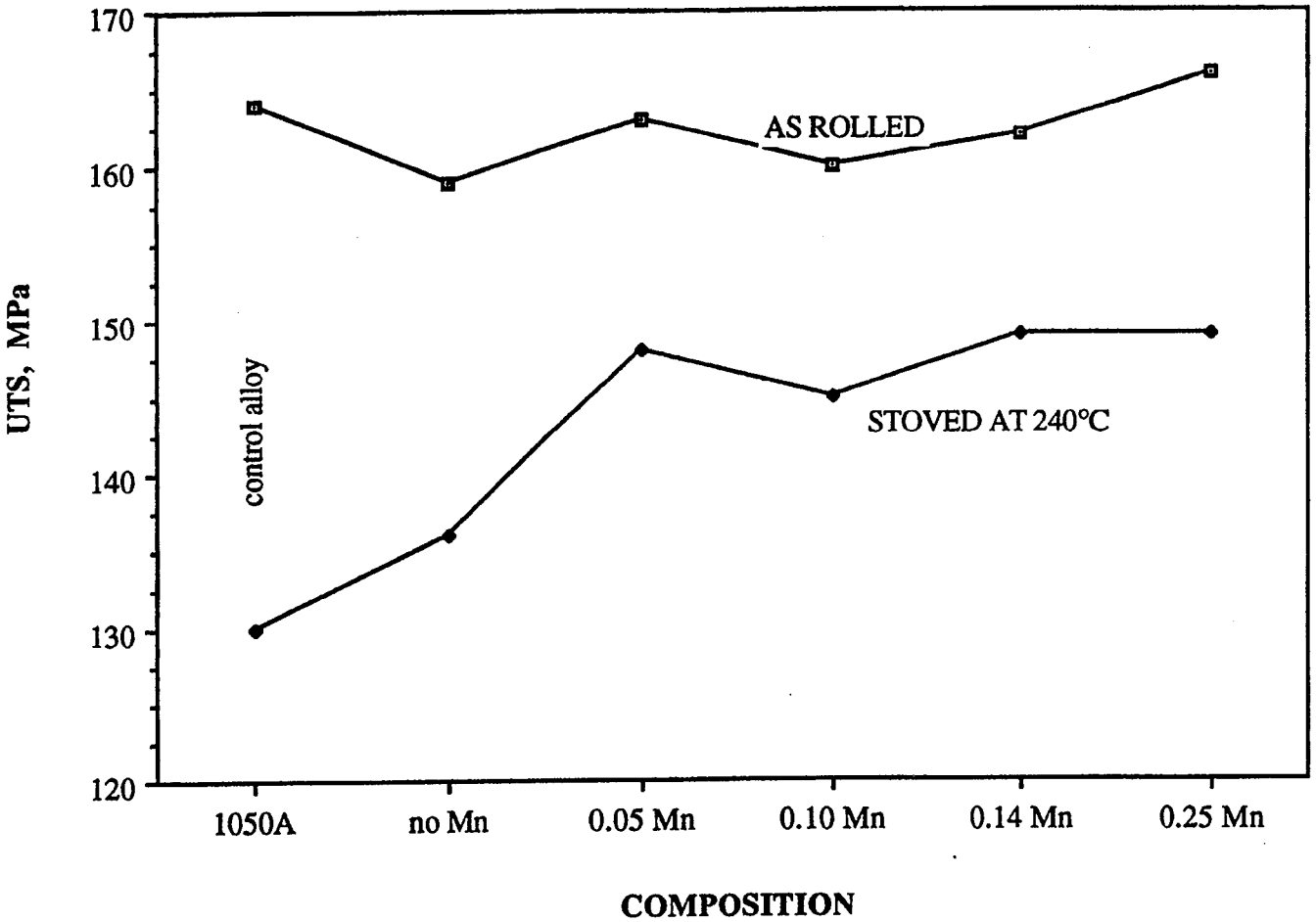
FIG. 3 is another graph dealing with Example 3, and plotting tensile strength against composition.

The results shown in FIGS. 2 to 3 are for the series of alloys in which the zirconium content was maintained at 0.04% by weight and the amount of manganese was increased in steps from 0 to 0.25 weight percent. For comparison, the results for the reference AA 1050A alloy are also included. In FIG. 2 the four columns for each alloy sample show the results for the alloy as rolled, and after heating for ten minutes at the three different temperatures, 240°, 270° and 300° C. For clarity, the graph shown in FIG. 3 reproduces the data presented in FIG. 2, but only for the samples as rolled and when heated (stoved) at 240° C.

As can be seen from FIGS. 2 and 3 the addition of 0.05% manganese to the reference alloy containing 0.04% zirconium shows an immediate improvement in UTS after stoving at all three temperatures. Further additions of manganese up to 0.25% similarly significantly reduce the loss in strength that occurs to the alloys after stoving, as is shown more clearly in FIG. 3. At the highest concentration of manganese the as rolled strength has increased due to the influence of manganese on the work hardening of the alloy, but the loss of strength as a result of stoving has also increased.

Figure 4:
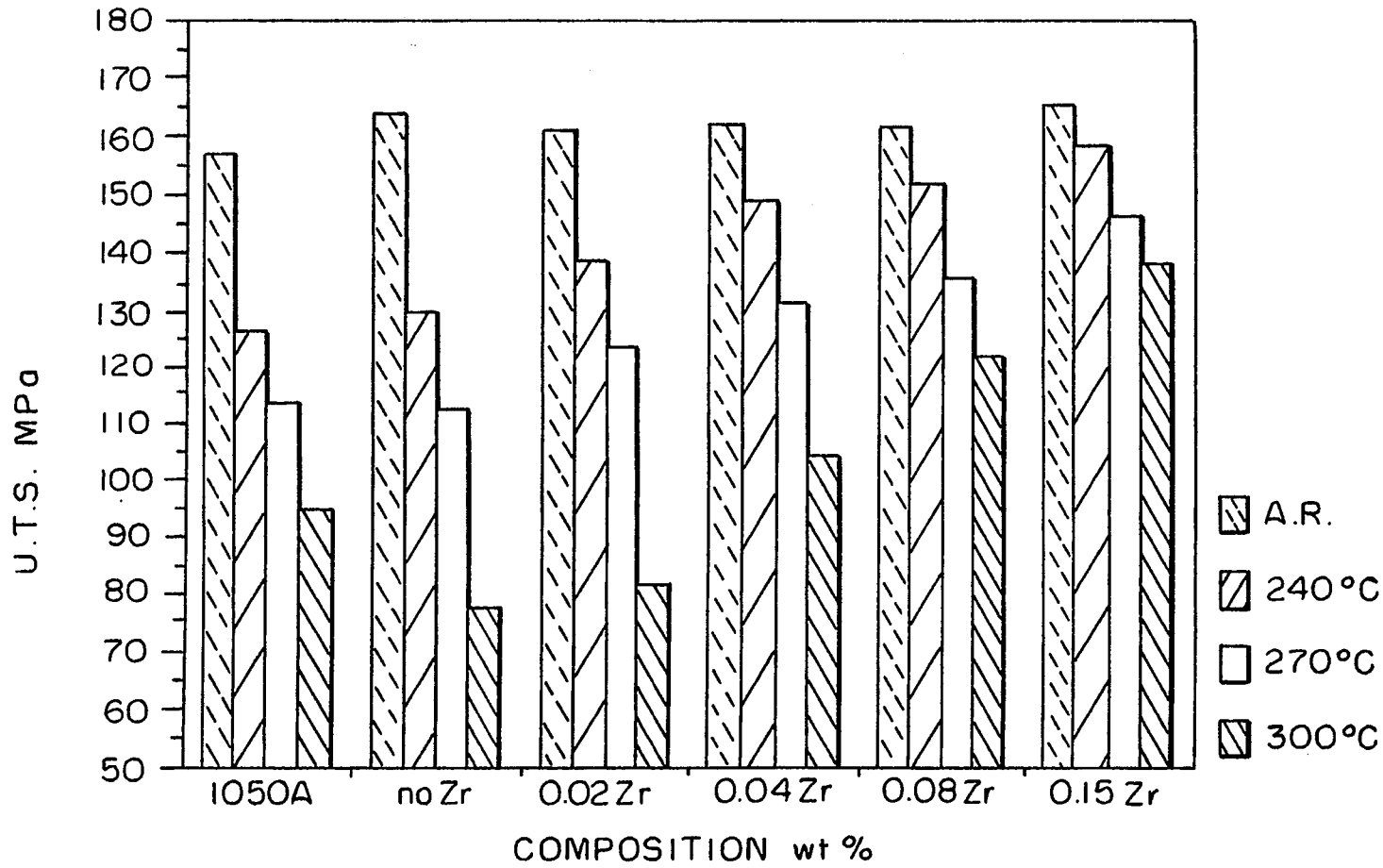
FIG. 4 is another bar graph similar to FIG. 2, also dealing with Example 3.
Figure 5:
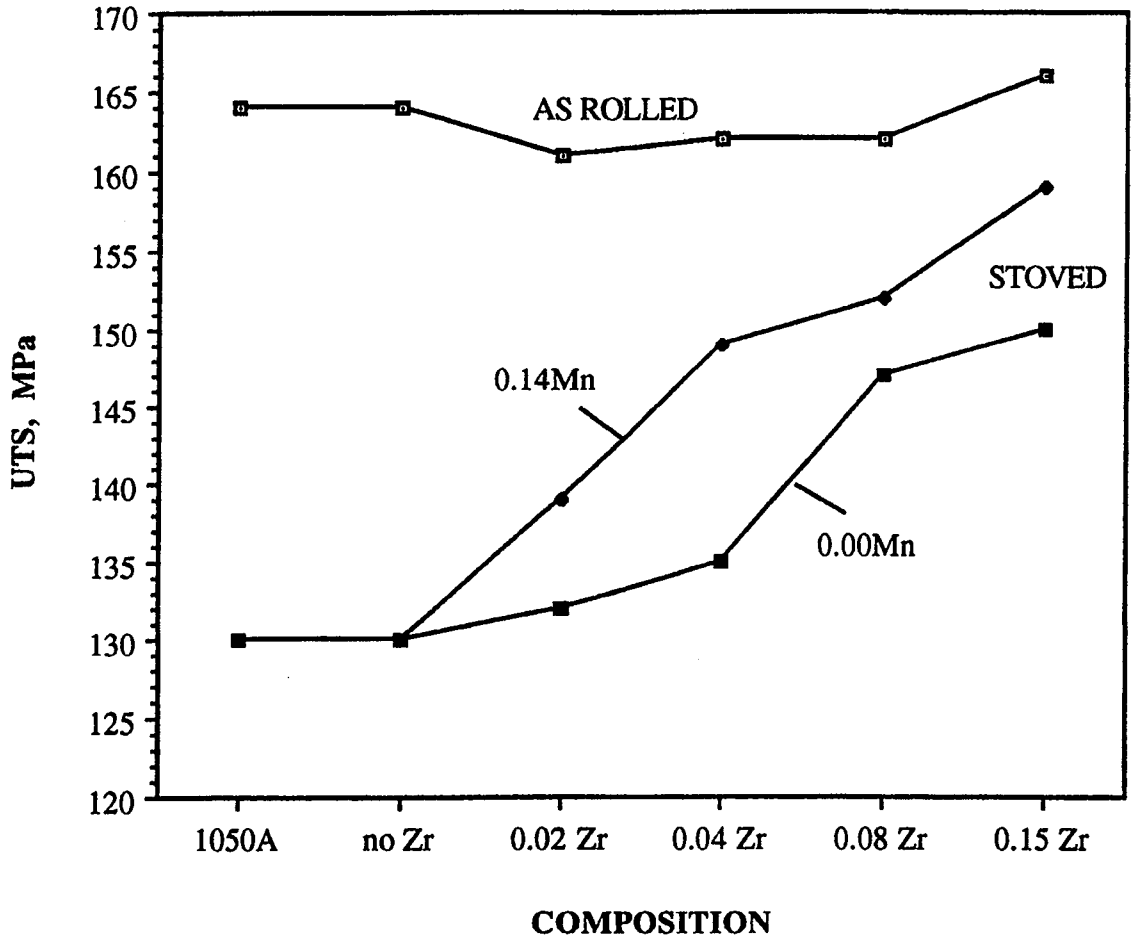
FIG. 5 is another graph, similar to that of FIG. 3, again dealing with Example 3 below.

Similar results are presented in FIGS. 4 and 5 which relate to the series of alloys in which the zirconium content is increased in steps from 0 to 0.15 weight percent, whilst maintaining the manganese content at 0.14%. Again the results for the reference 1050A alloy are included for comparison.

As can be seen from FIGS. 4 and 5, there is no measurable benefit in the addition of manganese alone without the presence of zirconium. With the addition of increasing amounts of zirconium the loss in strength due to stoving is reduced, i.e. the stoving resistance of the alloy is increased.

FIG. 5 reproduces the data presented in FIG. 4, but only for the samples as rolled and when heated (stoved) at 240° C. For comparison, a set of results are also included in FIG. 5 for increasing amounts of zirconium with no manganese present in order amply to demonstrate the benefit of the combined addition of manganese and zirconium.

What is claimed is:

1. In a lithographic printing plate made from an aluminum alloy, the improvement wherein said alloy consists essentially of at least 99.00% by weight of aluminum, from 0.02 to 0.15% by weight in total of zirconium and/or hafnium and from 0.05 to 0.25 by weight of manganese, with the remainder being incidental impurities.

2. A lithographic printing plate in accordance with claim 1 wherein said aluminum is present in an amount of at least 99.30% by weight.

3. A lithographic printing plate in accordance with claim 1 wherein said aluminum is present in an amount of at least 99.50% by weight.

4. A lithograph printing plate in accordance with claim 1 wherein said aluminum alloy contains 0.02–0.08% by weight by zirconium.

5. A lithographic printing plate in accordance with claim 1 wherein said aluminum alloy contains about 0.04% by weight of zirconium.

6. A lithographic printing plate in accordance with claim 1 wherein said aluminum alloy contains 0.05–0.15% by weight of manganese.

* * * * *